US008950123B1

(12) United States Patent
Chai et al.

(10) Patent No.: US 8,950,123 B1
(45) Date of Patent: Feb. 10, 2015

(54) RAINWATER HEAD

(71) Applicants: Chongqing University, Chongqing (CN); Shenzhen Yuezhong (Group) Co., Ltd., Shenzhen (CN)

(72) Inventors: Hongxiang Chai, Chongqing (CN); Songming Tan, Chongqing (CN); Hong Wu, Chongqing (CN); Weijie Wang, Chongqing (CN); Ganlin Zhang, Chongqing (CN); Wei Chen, Chongqing (CN); Wei Kang, Chongqing (CN); Zhengsong Wu, Chongqing (CN); Sai Zhang, Chongqing (CN)

(73) Assignees: Chongqing University, Chongqing (CN); Shenzhen Yuezhong (Group) Co., Ltd., Shenzhen (CN)

( * ) Notice: Subject to any disclaimer, the term of this patent is extended or adjusted under 35 U.S.C. 154(b) by 0 days.

(21) Appl. No.: 14/055,841

(22) Filed: Oct. 16, 2013

(51) Int. Cl.
*E04D 13/08* (2006.01)
*E04D 13/04* (2006.01)

(52) U.S. Cl.
CPC ..... *E04D 13/04* (2013.01)
USPC ..... 52/16; 52/12; 52/95

(58) Field of Classification Search
USPC ..... 52/12, 16, 302.1, 94, 95, 96, 11, 13, 14, 52/15, 302.6, 302.7
See application file for complete search history.

(56) References Cited

U.S. PATENT DOCUMENTS 4,059,126 A * 11/1977 Nickerson ..... 137/142
4,168,717 A * 9/1979 Rinker ..... 137/135
4,171,706 A * 10/1979 Loftin ..... 137/1
4,171,709 A * 10/1979 Loftin ..... 137/128
4,219,428 A * 8/1980 Soderstroom ..... 210/522
4,513,768 A * 4/1985 Sarver et al. ..... 137/142
5,063,959 A * 11/1991 Peterson ..... 137/153
5,114,594 A * 5/1992 Rosebrock et al. ..... 210/767
5,407,091 A * 4/1995 Wallis ..... 220/565
5,433,845 A * 7/1995 Greene et al. ..... 210/170.03
5,681,455 A * 10/1997 Takai et al. ..... 210/154
5,849,181 A * 12/1998 Monteith ..... 210/163
6,068,765 A * 5/2000 Monteith ..... 210/170.03
6,182,680 B1 * 2/2001 Hart ..... 137/122
6,357,183 B1 * 3/2002 Smith ..... 52/15
6,527,005 B2 * 3/2003 Weaver ..... 137/312
6,537,446 B1 * 3/2003 Sanguinetti ..... 210/163
6,584,733 B2 * 7/2003 Wade ..... 52/14
6,833,067 B2 * 12/2004 Dresmann ..... 210/163
7,048,849 B2 * 5/2006 Wade ..... 210/154
7,096,627 B2 * 8/2006 Wade ..... 52/12
7,775,232 B2 * 8/2010 Takai ..... 137/122
7,891,907 B2 * 2/2011 Smith ..... 405/36
8,424,557 B1 * 4/2013 Russell ..... 137/357
8,528,263 B2 * 9/2013 Schmidt et al. ..... 52/16

(Continued)

*Primary Examiner* — James Ference
(74) *Attorney, Agent, or Firm* — Matthias Scholl P.C.; Matthias Scholl

(57) ABSTRACT

A rainwater head, including: a dome, a drainage pipe, a siphon, and a ball cock mechanism. The drainage pipe includes a drainage exit and a wall including a water outlet hole. The ball cock mechanism includes a floating ball, a connecting bar, a fulcrum, and a stopper. The drainage pipe is connected to the lower part of the dome. The drainage exit is arranged on the top of the drainage pipe. The drainage exit is adapted to be between 5 and 10 cm higher than the roof. The water outlet hole is arranged on the wall of the drainage pipe at a position having the same height as the roof or is lower than the roof. The siphon is disposed on the upper part of the drainage pipe. The inlet of the siphon faces the roof; and the outlet of the siphon extends inside the drainage pipe.

3 Claims, 2 Drawing Sheets

(56) References Cited

U.S. PATENT DOCUMENTS

2002/0152691 A1* 10/2002 Wade ..... 52/11
2003/0159384 A1* 8/2003 Warnecke ..... 52/302.1
2003/0201217 A1* 10/2003 Dresmann ..... 210/163
2005/0086883 A1* 4/2005 Wade ..... 52/302.1
2005/0203468 A1* 9/2005 Warnecke ..... 604/317
2008/0086953 A1* 4/2008 Graf ..... 52/12
2008/0105306 A1* 5/2008 Takai ..... 137/467.5
2008/0314457 A1* 12/2008 Platteel ..... 137/357

* cited by examiner

RAINWATER HEAD

BACKGROUND OF THE INVENTION

1. Field of the Invention

The invention relates to a roof drainage device, and more particularly to a rainwater head.

2. Description of the Related Art

A typical rainwater head includes a dome and a drainage pipe connected to the lower part of the dome. An opening is arranged on the top of the drainage pipe and functions as a drainage exit. When assembling the rainwater head, the drainage exit is disposed on a low-laying area that is relatively lower than the roof for draining the accumulated water out of the roof as soon as possible. However, with the enlargement of areas impervious to water, such as concrete constructions, asphalt pavements, and parking lots, water flow and the peak flow on the ground surface of the city increase in case of cloudbursts, which results more and more serious problems of urban waterlogging. Disadvantages of the present rainwater heads lie in that neither the drainage of the rainwater is prolonged nor the peak flow of the rainwater is reduced, so that urban waterloggings easily occur in case of frequent and heavy rainfalls.

SUMMARY OF THE INVENTION

In view of the above-described problems, it is one objective of the invention to provide a rainwater head that is capable of prolonging the drainage of the rainwater out of the roof and reducing urban waterlogging.

To achieve the above objective, in accordance with one embodiment of the invention, there is provided a rainwater head comprising: a dome, the dome comprising a lower part; and a drainage pipe, the drainage pipe comprising a top comprising a drainage exit, and a wall comprising a water outlet hole having a certain drainage capacity. The drainage pipe is connected to the lower part of the dome. The drainage exit is arranged on the top of the drainage pipe. The drainage exit is between 5 and 10 cm higher than a roof. The water outlet hole is arranged on the wall of the drainage pipe at a position that has the same height as the roof or is lower than the roof.

Because the drainage exit is between 5 and 10 cm higher than the roof, the water level of drainage of the roof increases. In case of cloudbursts, a certain amount of rainwater can be stored by the roof, so that the rainwater head of the invention is capable of prolonging the draining of the rainwater out of the roof, decreasing the peak flow of the rainwater on the ground surface of the city, and reducing the hazards of the urban waterlogging. Furthermore, as the water outlet hole is arranged on the wall of the drainage pipe, the rainwater head has a certain drainage capacity for draining off the accumulated rainwater from the roof in case of light rain, moderate rain, and cloudburst. Advantages of the invention are summarized as follows: the rainwater head of the invention is capable of prolonging the draining of the rainwater out of the roof and reducing the hazards of the urban waterlogging.

BRIEF DESCRIPTION OF THE DRAWINGS

The invention is described hereinbelow with reference to the accompanying drawings, in which.

Figure 1:
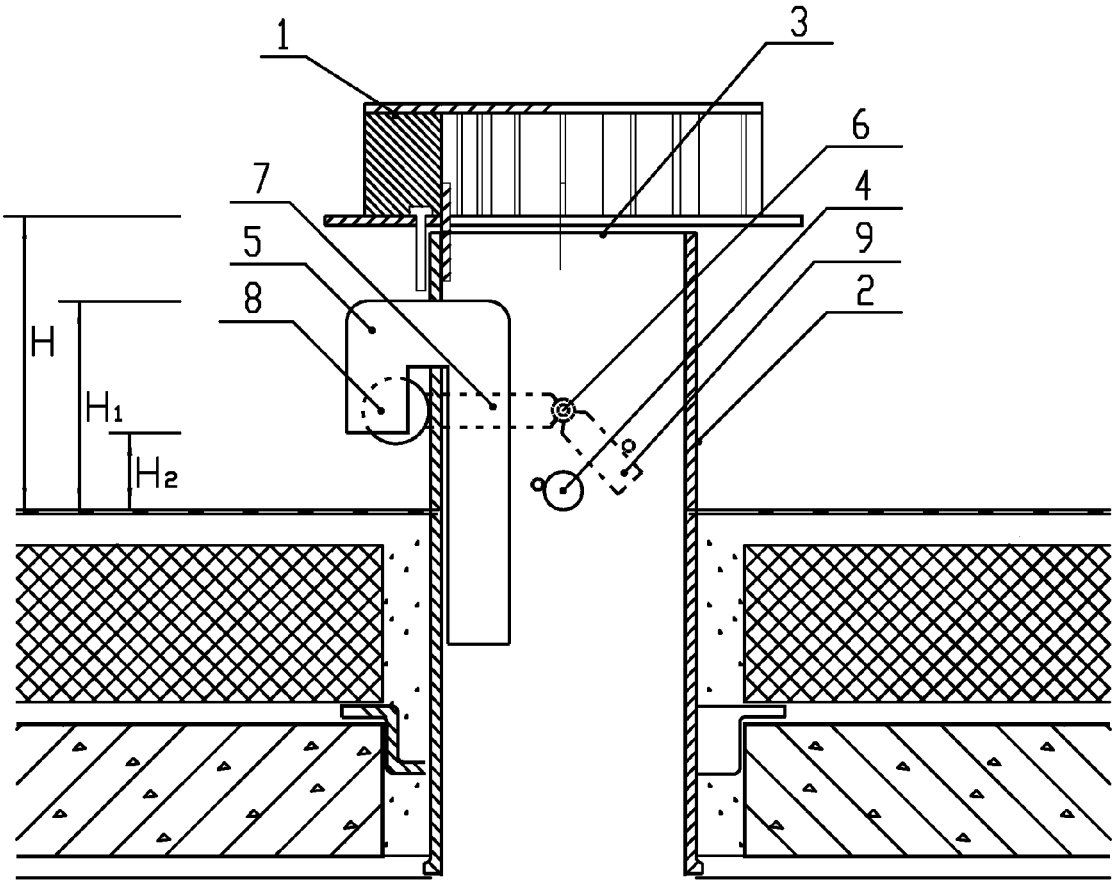
FIG. 1 is a structure diagram of a rainwater head in accordance with one embodiment of the invention.

In the drawings, the following reference numbers are used: 1. Dome; 2. Drainage pipe; 3. Drainage exit; 4. Water outlet hole; 5. Siphon; 6. Fulcrum; 7. Connecting bar; 8. Floating ball; and 9. Stopper.

DETAILED DESCRIPTION OF THE EMBODIMENTS

For further illustrating the invention, experiments detailing a rainwater head are described below. It should be noted that the following examples are intended to describe and not to limit the invention.

Figure 2:
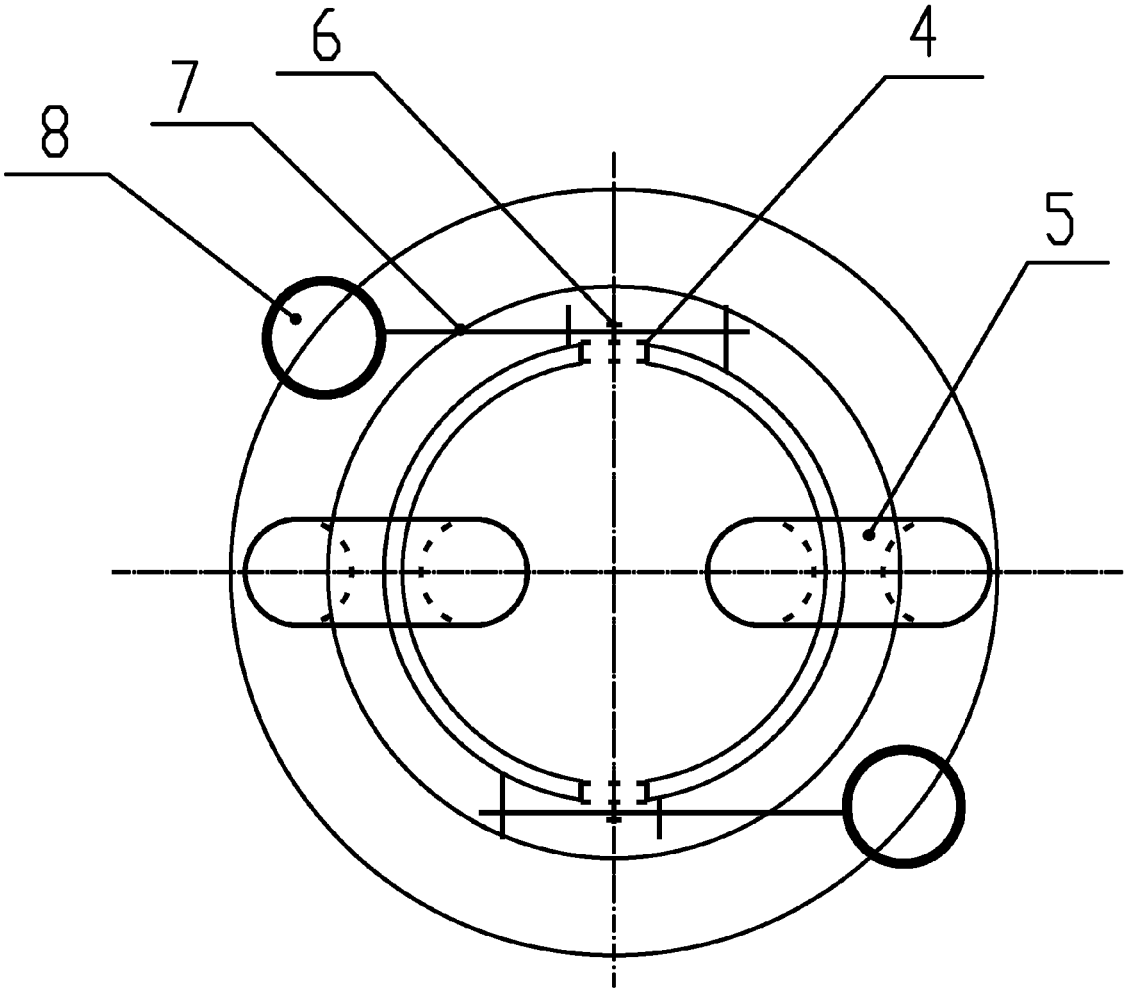
FIG. 2 is a top view of a drainage pipe in accordance with one embodiment of the invention.

As shown in FIGS. 1-2, a rainwater head comprises: a dome 1, the dome comprising a lower part; and a drainage pipe 2, the drainage pipe 2 comprising a top comprising a drainage exit 3, and a wall comprising a water outlet hole 4 having a certain drainage capacity. The drainage pipe 2 is connected to the lower part of the dome 1. The drainage exit 3 is arranged on the top of the drainage pipe 2. The drainage exit is between 5 and 10 cm higher than a roof. The water outlet hole 4 is arranged on the wall of the drainage pipe at a position that has the same height as the roof or is lower than the roof.

Because the drainage exit 3 is between 5 and 10 cm higher than the roof, the water level of drainage of the roof increases. In case of cloudbursts, a certain amount of rainwater can be stored by the roof, so that the rainwater head of the invention is capable of prolonging the time for draining the rainwater out of the roof, decreasing the peak flow of the rainwater on the ground surface of the city, and reducing the hazards of the urban waterlogging. Furthermore, as the water outlet hole 4 is arranged on the wall of the drainage pipe 2, the rainwater head has a certain drainage capacity for draining off the accumulated rainwater from the roof in case of light rain, moderate rain, and cloudburst.

The height difference between the drainage exit 3 and the roof is determined by the rainfall amount precipitating in different regions and the requirement of the roof load according to *Load Code for the Design of Building Structure* (National Standard of the People's Republic of China), and a preferable height difference is within the range of between 5 and 10 cm.

Because the water outlet hole 4 has a limited drainage capacity, a siphon 5 is disposed on an upper part of the drainage pipe 2 to facilitate the water drainage out of the roof after the cloudburst. The siphon 5 comprises an inlet and an outlet; the inlet of the siphon 5 faces the roof; and the outlet of the siphon 5 extends inside the drainage pipe 2.

Different rainfall amounts impose different requirements on the water outlet hole 4 arranged on the drainage pipe 2. In general, the water outlet hole 4 is required to have a complete drainage capacity. In case of cloudburst, the drainage capacity of the water outlet hole 4 is required to be reduced, or even to be closed, to realize the retention of the rainwater. The rainwater head further comprises a ball cock mechanism. The ball cock mechanism comprises a floating ball 8, a connecting bar 7, a fulcrum 6, and a stopper 9. The fulcrum 6 is arranged on the wall of the drainage pipe 2 above the corresponding water outlet hole 4. The floating ball 8 is fixed on the fulcrum 6 via the connecting bar 7. The stopper 9 comprises two ends, one end is fixed on the fulcrum 6, and the other end is inclined downward close to the water outlet hole 4. When the roof has no accumulated water or a height of the accumulated water is relatively low, the floating ball 8 is in a preset state, and the water outlet is open. When the accumulated water on the roof reaches a preset height, the floating ball 8 floats upwardly and drives the fulcrum 6 to rotate thereby driving the stopper 9 to rotate. When the stopper 9 obstructs the water outlet hole 4, the water outlet hole 4 is in a close state.

Working process of the rainwater head of the invention is summarized as follows: in case of no rain or cloudburst having a relatively low intensity when a depth of the accumulated water on the roof is lower than $H_1$, the water outlet hole 4 is in the open state or a semi-close state, rainwater is drained through the water outlet hole 4. In case of cloudburst having a high intensity, the rainwater flow Q is relatively large during an early stage of the cloudburst, and the depth of the accumulated water on the roof increases with the prolonging of the duration of the rainfall, so that the floating ball 8 floats upwardly. The water outlet hole 4 closes and the siphon 5 starts to work if the rainwater depth on the roof is $H_1$. As the depth of the accumulated water on the roof continuously increases, the siphon 5 and the drainage exit 3 of the rainwater head start to work simultaneously to drain the rainwater once the depth is larger than H. The drainage capacities of the siphon 5 and the water outlet hole 4 are limited, therefore, the rainwater discharged out of the roof is insignificant and the rainwater is basically in a storage state before the water depth is smaller than H. With the decrease of the cloudburst intensity, the rainwater flow Q is gradually lowered. When the rainwater flow Q<a displacement $Q_1$ of the rainwater head (a displacement of the drainage exit 3+a displacement of the siphon 5), the water level decreases. When the water depth on the roof is lowered to $H_1$, the floating ball 8 begins to descend, the water outlet hole 4 gradually opens, and the rainwater is discharged out of the roof via the siphon 5 and the water outlet hole 4. When the water depth on the roof is lowered to $H_2$, the siphon 5 stops draining water, and the remained rainwater is gradually drained from the water outlet hole 4.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

The invention claimed is:

1. A rainwater head for draining water from a roof, the rainwater head comprising:

a) a dome (1), said dome comprising a lower dome part;

b) a drainage pipe (2), said drainage pipe (2) comprising a pipe top comprising a drainage exit (3), a pipe wall comprising a water outlet hole (4) having drainage capacity, and a water inlet opening being adapted to be connected to a surface of the roof; and c) a ball cock mechanism, said ball cock mechanism comprising a floating ball (8), a connecting bar (7), a fulcrum (6), and a stopper (9);

wherein:

said drainage pipe (2) is connected to said lower dome part;

said drainage exit (3) is arranged on said pipe top;

said drainage exit is adapted to be disposed at a first position that is higher than the surface of the roof, a first distance is formed between said first position and the surface of the roof, and said first distance is equal to a first preset value;

said water outlet hole (4) is adapted to be arranged on said pipe wall at a second position that is located as high as the surface of the roof or is lower than the surface of the roof;

said fulcrum (6) is arranged on said pipe wall above said water outlet hole (4);

said floating ball (8) is fixed on said fulcrum (6) via said connecting bar (7);

said stopper (9) comprises a first stopper end fixed on said fulcrum (6), and a second stopper end inclined downward with respect to said first stopper end and in close proximity to said water outlet hole (4) for the purpose of enclosing said water outlet hole (4); and said floating ball (8) is adapted to be disposed outside of said drainage pipe (2) and be exposed to the water;

said floating ball (8) is movable with the level of the water with respect to the surface of the roof;

when in use:

when said floating ball (8) is moved with the level of the water with respect to the surface of the roof, said floating ball (8) drives said connecting bar (7) to rotate about said fulcrum (6), and said connecting bar (7) drives said stopper (9) and said second stopper end to rotate about said fulcrum (6);

when said floating ball (8) is moved with the level of the water with respect to the surface of the roof, said connecting bar (7) carrying said floating ball (8) and said stopper (9) carrying said second stopper end rotate about said fulcrum (6) in a same direction; whereby when said floating ball (8) is moved upwards, said second stopper end is moved downwards, and when said floating ball (8) is moved downwards, said second stopper end is moved upwards;

when the level of the water with respect to the surface of the roof is equal to or higher than a second preset value, said second stopper end is moved to enclose said water outlet hole (4) to stop draining water from the roof;

when the level of the water with respect to the surface of the roof is lower than said second preset value, said second stopper end is moved to open said water outlet hole (4) to start draining water from the roof; and said second preset value is smaller than said first preset value.

2. The rainwater head of claim 1, wherein when in use, when the level of the water with respect to the surface of the roof is higher than said second preset value and lower than said first preset value, the water is stored in said drainage pipe (2) and on the roof.

3. The rainwater head of claim 1, wherein when in use, when the level of the water with respect to the surface of the roof is higher than said first preset value, the water is stored in said drainage pipe (2), on the roof, and in said dome (1).

* * * * *